US005794925A

United States Patent [19]

Fantl et al.

[11] Patent Number: 5,794,925

[45] Date of Patent: Aug. 18, 1998

[54] APPARATUS FOR HOLDING A LOCK ASSEMBLY AND SHEARING THE ASSEMBLY PINS THEREOF

[75] Inventors: Steven Albert Fantl, Colgate; Robert Douglas Weis, New Berlin, both of Wis.

[73] Assignee: Master Lock Company, Milwaukee, Wis.

[21] Appl. No.: 528,175

[22] Filed: Sep. 14, 1995

[51] Int. Cl.[6] ..... B25B 5/04

[52] U.S. Cl. ..... 269/237; 269/238; 269/239; 269/296; 269/298

[58] Field of Search ..... 269/231, 237, 269/238, 239, 254 R, 296, 298, 299

[56] References Cited

U.S. PATENT DOCUMENTS

| | | | |
|---|---|---|---|
| 2,183,680 | 12/1939 | Kahliff | 269/238 |
| 2,529,452 | 11/1950 | Janes et al. | 269/239 |
| 2,579,878 | 12/1951 | Stone . | |
| 2,638,805 | 5/1953 | Bigelow | 269/239 |
| 2,989,337 | 6/1961 | Pispisa | 269/238 |
| 3,385,592 | 5/1968 | Hassell et al. . | |
| 3,896,699 | 7/1975 | Cerro | 269/254 R |
| 4,366,606 | 1/1983 | Willis et al. | 269/238 |
| 4,877,228 | 10/1989 | Ripert . | |
| 5,294,099 | 3/1994 | Dalfino . | |

*Primary Examiner*—Timothy V. Eley
*Assistant Examiner*—Lee Wilson
*Attorney, Agent, or Firm*—Pennie & Edmonds LLP

[57] ABSTRACT

A holding device for padlocks having lock housings of different sizes. The holding device includes guides for positioning the padlocks so that a shell-plug assembly disposed within the lock housing is maintained at a prescribed location. The holding device is attached to a shearing apparatus for shearing assembly pins in the shell-plug assembly.

6 Claims, 10 Drawing Sheets

APPARATUS FOR HOLDING A LOCK ASSEMBLY AND SHEARING THE ASSEMBLY PINS THEREOF

BACKGROUND OF THE INVENTION

The invention relates to a shearing apparatus and holding device for holding the lock shell-plug assembly of locks and lock housings in position for performing a shearing operation on the assembly pins contained within the shell-plug assembly. Locks with shearable pins are disclosed in U.S. Pat. No. 1,953,535 to Hurd and in copending application Ser. No. 08/388,950 filed Feb. 15, 1995 and assigned to the same assignee as the present application. The copending application discloses locks with two different types of shell-plug assemblies having shearable pins mounted in pin passageways extending in the shell and plug portions of the assembly. In one embodiment the plug is moved axially within the shell to shear the assembly pins and then moved back to its original position for subsequent mounting within a lock housing. In the other embodiment the shell-plug assembly is contained within a lock housing and the pins are sheared by movement of the plug from a first position to a final shifted position within the shell. The prior copending application is incorporated herein by reference for a further disclosure of these structures.

The prior copending application also discloses a shearing apparatus for holding a shell-plug assembly for shearing of the assembly pins. The shearing apparatus includes a recess for receiving the shell-plug and holding the shell against movement. The apparatus further includes a plunger for engaging the plug of the shell-plug assembly and moving it within the shell to cause shearing of the assembly pins. Although the shearing apparatus of the copending application may be used for shearing the assembly pins in a shell-plug assembly which is outside a lock housing or already mounted in a lock housing, the apparatus is not specifically configured to receive certain types of locks in which the shell-plug assembly is already mounted within the lock housing, as is, for example, the case with padlocks.

SUMMARY OF THE INVENTION

In accordance with the teachings of the present invention the shearing apparatus of the copending application is improved by providing a holding device for padlocks having lock housings of different sizes. The holding device includes guides for positioning the padlocks within the holding device so that the shell-plug assembly disposed within the lock housing is maintained at a prescribed location regardless of the size of the padlock. In addition, the holding device is attached to the shearing apparatus in such a way so as to permit a shearing of the assembly pins in the shell-plug assembly contained within the lock housing.

DETAILED DESCRIPTION OF THE INVENTION

Figure 1:
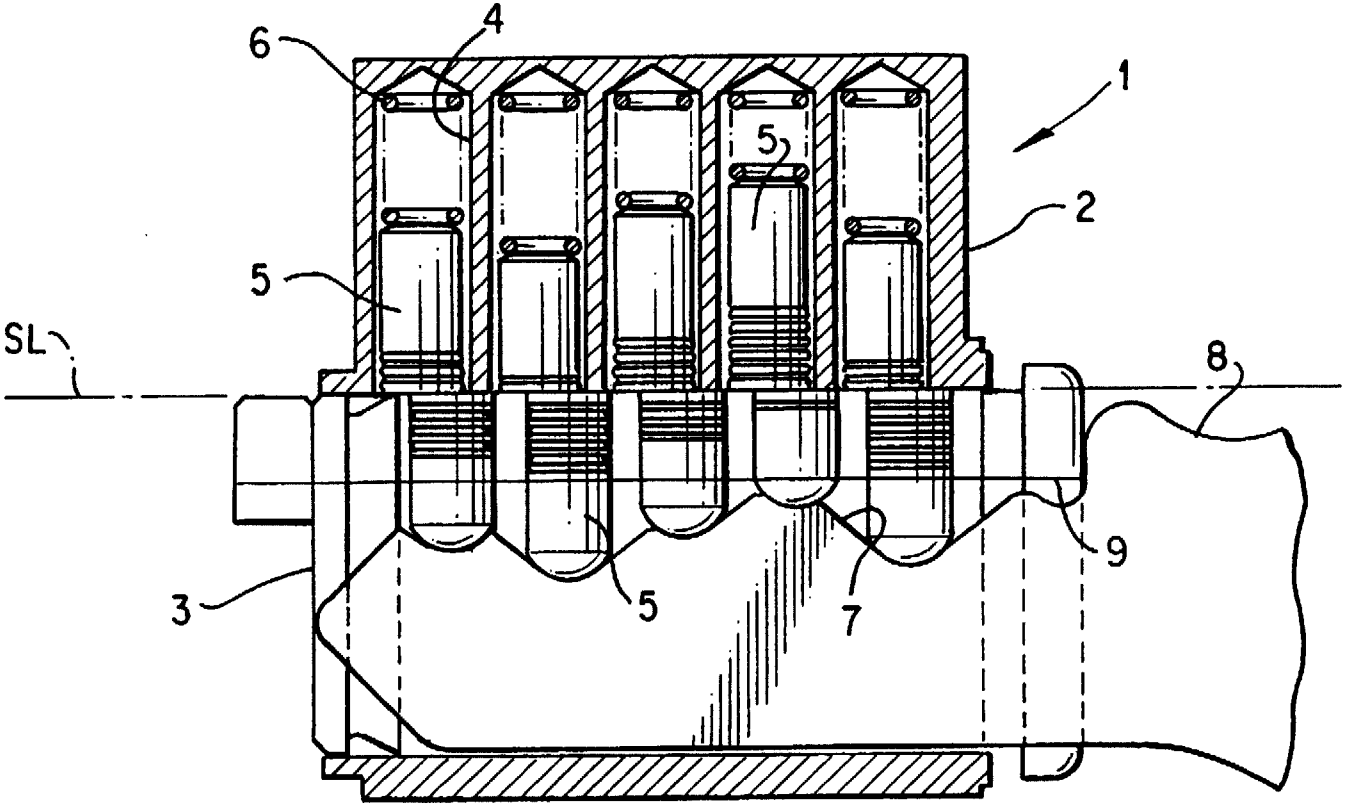
FIG. 1 is a partial cross-sectional view of a shell-plug assembly with shearable assembly pins.

FIG. 1 shows a shell-plug assembly 1 comprised of a shell 2 and a rotatable plug 3 mounted within the shell. The longitudinal axes of the shell and the plug are coincident in the assembled condition of the two members. Pin passageways 4 extend into the shell and plug. Mounted within each passageway 4 is a shearable pin 5 and a spring 6 for urging the pin downwardly. FIG. 1 shows the plug of the shell-plug assembly in a shifted position along the longitudinal axis of the shell whereby the assembly pins 5 have been sheared in accordance with the configuration 7 of a key 8 which had been previously inserted into a keyhole 9 of the plug 3 to position the assembly pins in aligned position for shearing along a shear line SL defined between the shell and plug. After the shearing operation the plug is moved back to its original position with the pin passageways 4 aligned with each other. The plug is next fixed to the shell against further axial movement, and the assembly is then ready for mounting within a lock housing, as for example, the lock housing of a door lock.

Figure 2:
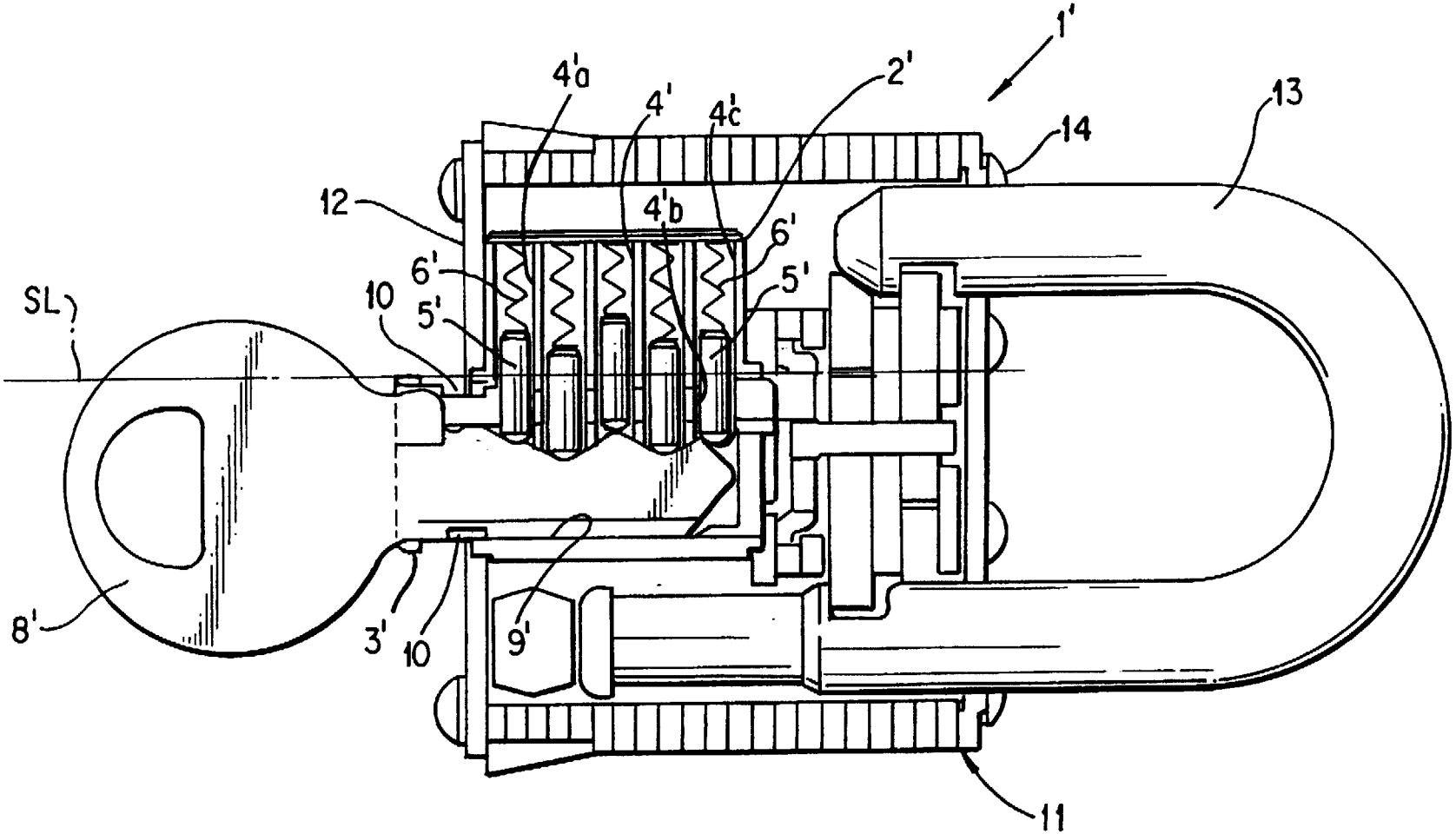
FIG. 2 is a partial cross-sectional view of a padlock including a lock housing and a shell-plug assembly with shearable assembly pins.

FIG. 2 shows a shell lock assembly 1' comprised of a shell 2', a plug 3' and pin passageways 4' for the reception of assembly pins 5'. Springs 6' are provided in the passageways for urging the pin assemblies downwardly toward a key 8' positioned within a keyhole 9' in the plug. In the embodiment of the lock shown in FIG. 2 the plug 3' includes an annular undercut 10 for receiving the sheared portion of an assembly pin when the plug is shifted from a position shown in FIG. 2 to a position to which the annular undercut is aligned with the immediately adjacent pin passageway 4'a and the assembly pins have been sheared as disclosed in the co-pending application. In this position, the pin passageway 4'b in the plug 3' which is furthest from the keyhole 9, will be positioned beyond and out of alignment with the pin passageway 4'c in the shell 2' which is furthest from the keyhole.

The shell-plug assembly 1' of FIG. 2 is shown as mounted in a lock body or housing 11 of a padlock, with the plug of the shell-plug assembly extending outwardly of one end 12 of the lock housing. The shackle 13 of the padlock extends from the opposite end 14 of the lock housing 11.

Figure 3:
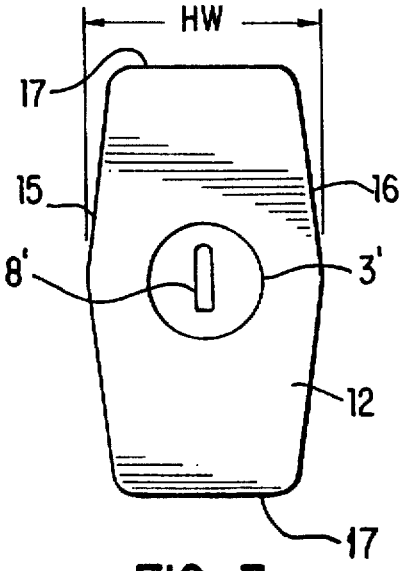
FIG. 3 is an end view of the lock housing of FIG. 2.

FIG. 3 shows the shape of the lock housing as defined by opposite front and back walls 15, 16 and opposite side walls 17 which connect the front and back walls together. The front and back walls have a maximum width HW centrally between the side walls 17. Also the plug 3' of the shell-plug assembly is disposed centrally between the side walls 17.

Figure 4:
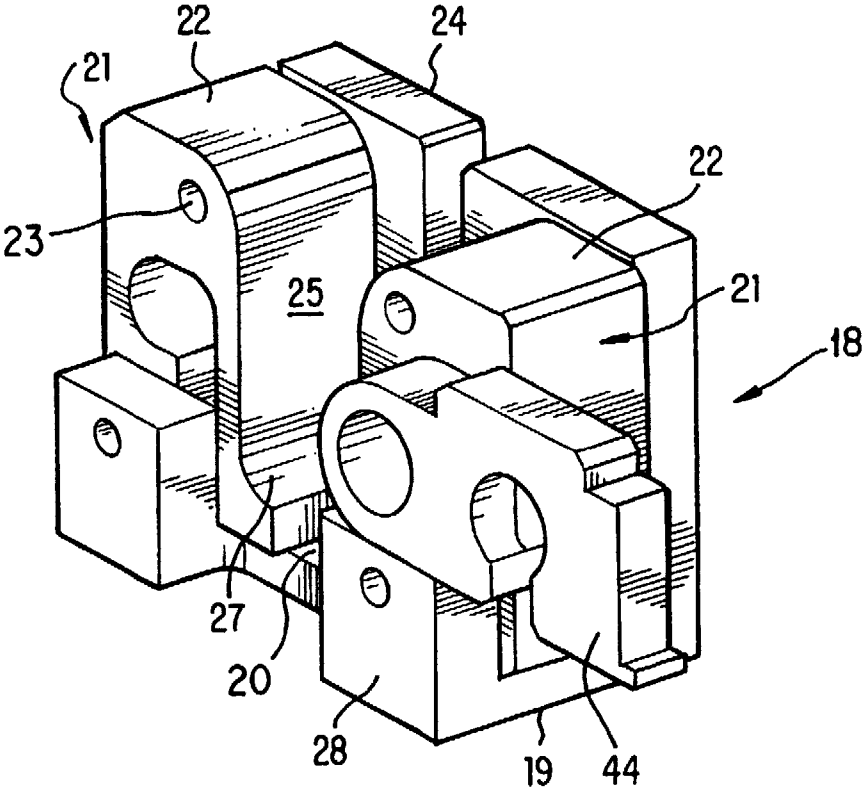
FIG. 4. is a perspective view of the holding device of the present invention.

FIG. 4 shows, in perspective, the holding device 18 for the lock housing 11 of the padlock shown in FIGS. 2 and 3, while FIGS. 5–8 show different views of the holding device as connected to the shearing apparatus. The holding device 18 includes a horizontal base 19 defining a support 20 for a lock housing, as more fully described below. A pair of guide members 21 are pivotally mounted at their upper ends 22 on pivots 23. The pivots are secured in upstanding members 24 of the holding device. The guide members are spaced horizontally from each other to provide opposed horizontally spaced surfaces 25 between which the lock housing is adapted to be positioned. The lower end 26 of each guide member includes a support arm 27. The arms extend toward each other and together provide a second support for smaller sized lock housings of the padlock shown in FIGS. 2 and 3, and as more fully described below.

Figure 5:
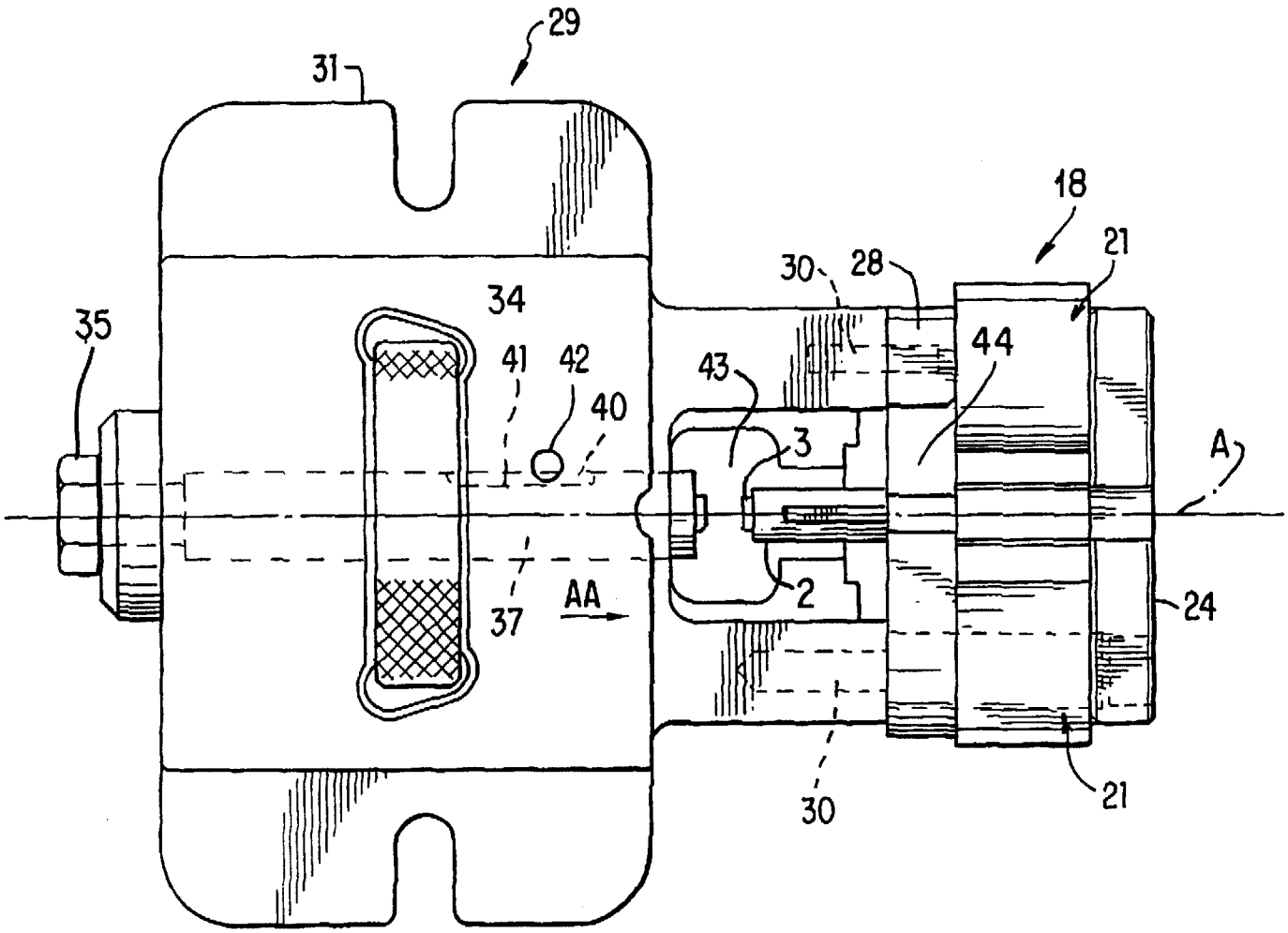
FIG. 5 is a top plan view of a pin shearing apparatus with the holding device attached at one end thereof and ready to shear pins in a shell-plug assembly positioned in the apparatus.
Figure 6:
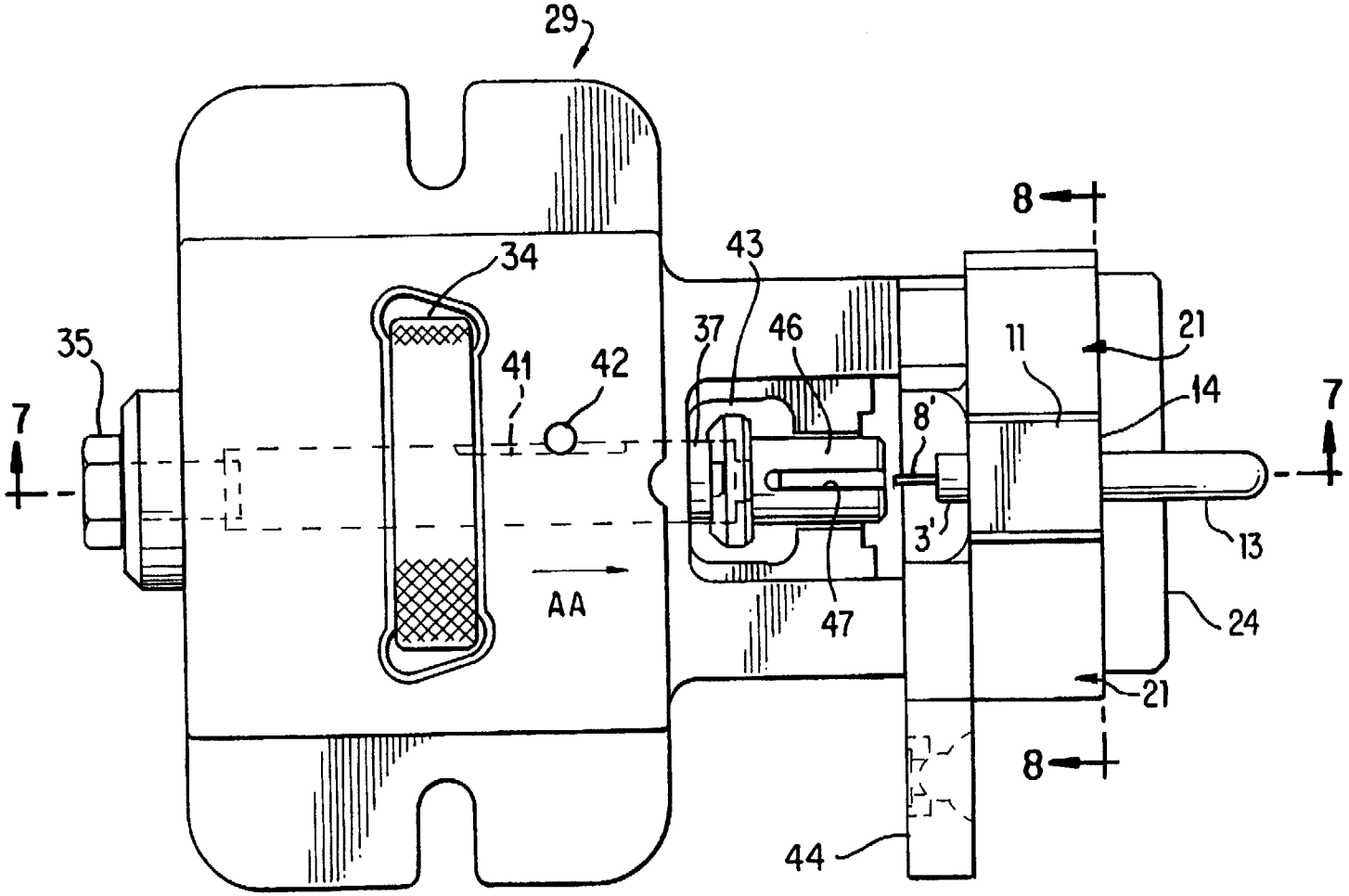
FIG. 6 is a view similar to FIG. 5 ready to shear pins in a shell-plug assembly contained within a lock housing positioned in the holding device.
Figure 7:
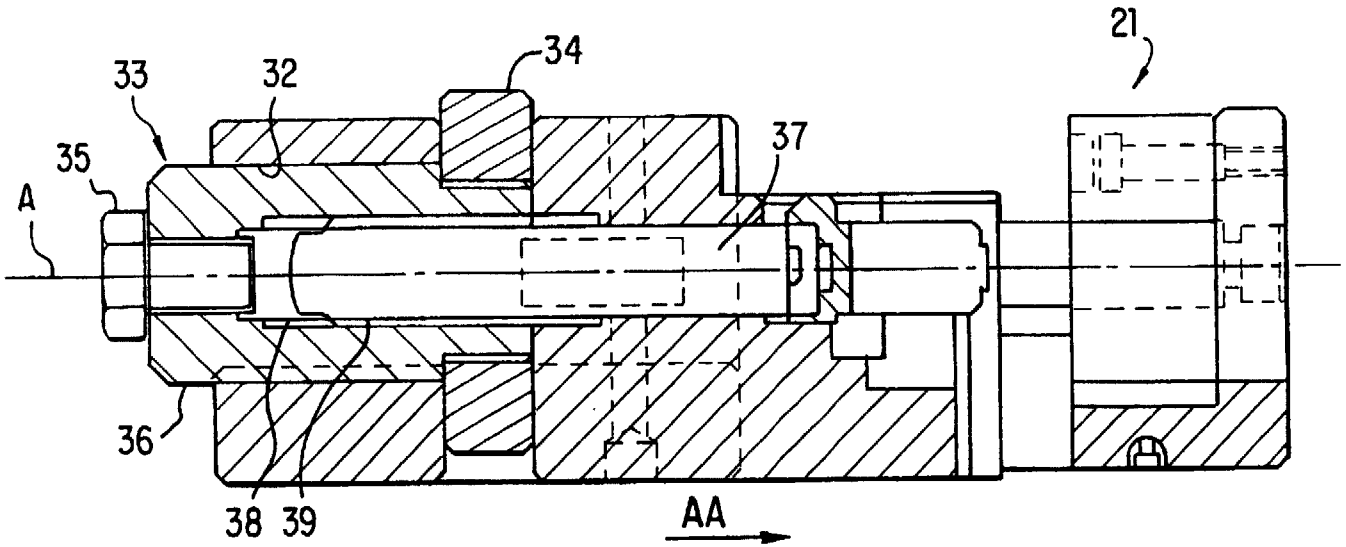
FIG. 7 is a cross-sectional view of along lines 7—7 of FIG. 6.

The holding device includes an attaching structure 28 for attaching the holding device to the shearing apparatus 29 shown in FIGS. 5–7. Suitable bolts 30 (FIG. 5) are used for this purpose.

As further shown in FIGS. 5–7, the shearing apparatus 29 includes a body 31, a body cavity 32, a turnable drive unit 33 mounted in the cavity 32 for rotation about the longitudinal axis A of the apparatus. The turnable drive unit 33 includes a hand wheel 34 and a nut 35, which are mounted in a rotatable drive body 36 of drive unit 33. Nut 35 is turnable by a wrench (not shown) to turn drive unit 33. As drive unit 33 is turned, it translates a plunger 37 through mating threads 38 on body 36 of unit 33 and threads 39 on the plunger 37. Plunger 37 moves linearly in an advance direction AA. Plunger 37 is held from turning by indentation 40 having a flat surface 41 and by a vertical post 42 which engages surface 41 to prevent rotation. The shearing apparatus 29 also includes a lock holder recess 43 including shell holding means in the form of a support wall 44 which holds the shell of the shell-plug assembly against translation in direction AA.

In the operation of apparatus 29, the shell-plug assembly is placed in a holder recess 43. The plunger 37, which is on one side of the recess 43, is advanced, by turning the handwheel 34, until it touches the plug 31. A wrench is then used to turn nut 35 to translate plug 3 relative to its shell 2 until the assembly pins 5 shear. After the pins have been sheared, handwheel 34 can be turned in the appropriate direction to rotate drive unit 33 and thereby translate plunger 37 in a direction opposite direction AA. This releases the shell-plug assembly for removal from the shearing apparatus.

As shown in FIG. 5 the support wall 44 which defines the shell holding means is positioned along the axis A and between the recess and at the holding device 18, which itself is on side of the recess opposite the plunger 37. In the position of the wall as shown in FIG. 5, the wall is also in blocking alignment with the longitudinal axis of the shell-plug assembly to hold the shell against movement during the shifting of the plug and the shearing of the assembly pins.

As shown in FIG. 6 the support wall 44 has been moved from a position shown in FIG. 5 to a position spaced from the axis A and the longitudinal axis of the shell-plug assembly. In the position shown in FIG. 6, there is direct communication, through the recess 43, between the plunger 37 and the holding device 18. This is necessary for providing plunger access to the shell-plug assembly of the lock housing situated in the holding device.

When the shearing apparatus 29 is used in conjunction with the holding device 18, a plunger extension piece 46 is connected to the forward end of the plunger 37. As shown in FIG. 6 the extension piece is provided with a slot 47 for receiving the key 8' as the plunger moves in its advance direction AA and into engagement with the plug 3'. The plunger therefor shifts the plug 3' in the direction AA and causes shearing of the assembly pins contained within the shell-plug assembly contained within the lock housing 11. During the shearing operation the shell of the shell-plug assembly is held against movement by the engagement of the upstanding members 24 of the holding device engaging against the end 14 of the lock housing. As seen in FIG. 6 the upstanding members 24 are spaced from each other to provide an opening for which the shackle 13 of the lock housing extends.

With the shearing apparatus and the connected holding device as described above, it will be apparent that the shearing apparatus can be used for shearing the assembly pins in a shell-plug assembly whether it be contained in a housing or not. Typically, shell-plug assemblies for door locks would be placed in the lock holder recess 43 without any surrounding housing. Alternatively, the holding device 18 is used for shearing the assembly pins of a shell-plug assembly mounted within a lock housing, as is the case with preassembled padlocks. The shearing apparatus is particularly suited for use by locksmiths or in hardware stores to customize door locks and padlocks for operation by a common key or for customizing new door locks and padlocks to the existing key of a customer so as to match the new locks with locks already installed in the customers home or otherwise used by the customer.

In addition to the above, the holding device of the present invention is constructed for accommodating lock housings, particularly padlocks, of different sizes. As shown in FIG. 3 the bottom end of a typical padlock has the shell-plug assembly centrally mounted between the front and back walls 15, 16 and the side walls 17 of the padlock. Thus, when padlocks of different sizes are placed with one of the side walls 17 resting on the support of the holding device, the longitudinal axis of the shell-plug assembly will vary in height from the support. The holding device of the present invention is constructed to accommodate this difference and properly align the shell-plug assembly with the plunger extension piece 46.

Figure 8:
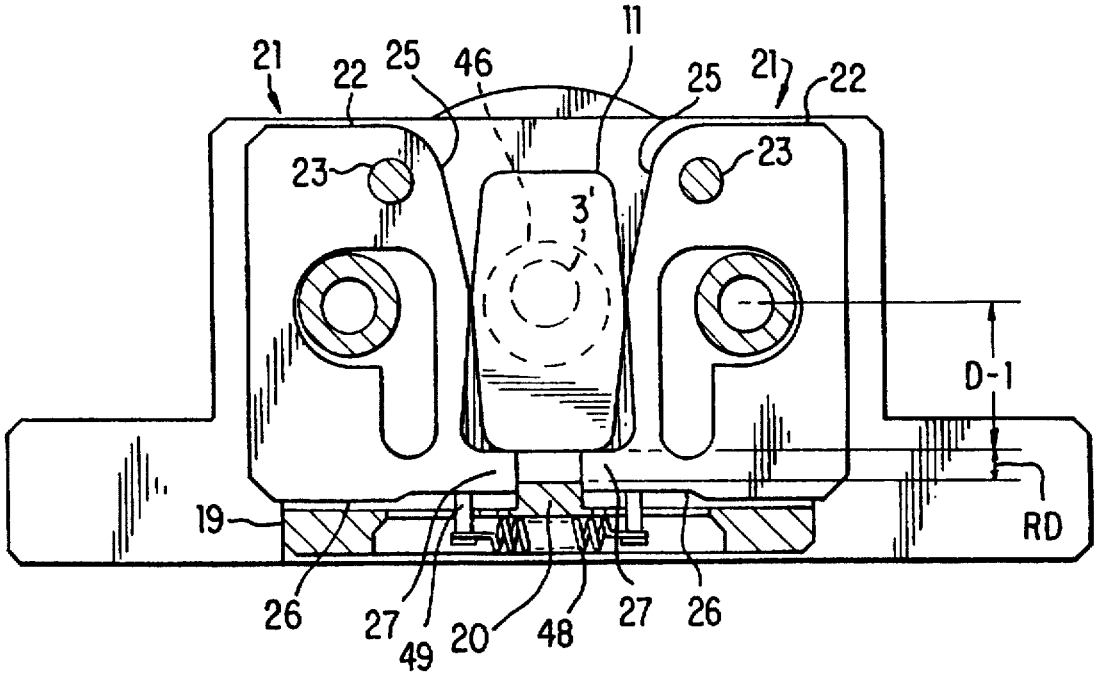
FIG. 8 is a cross-sectional view taken along lines 8—8 of FIG. 6; with a lock housing of a first size shown schematically in the holding device.
Figure 9:
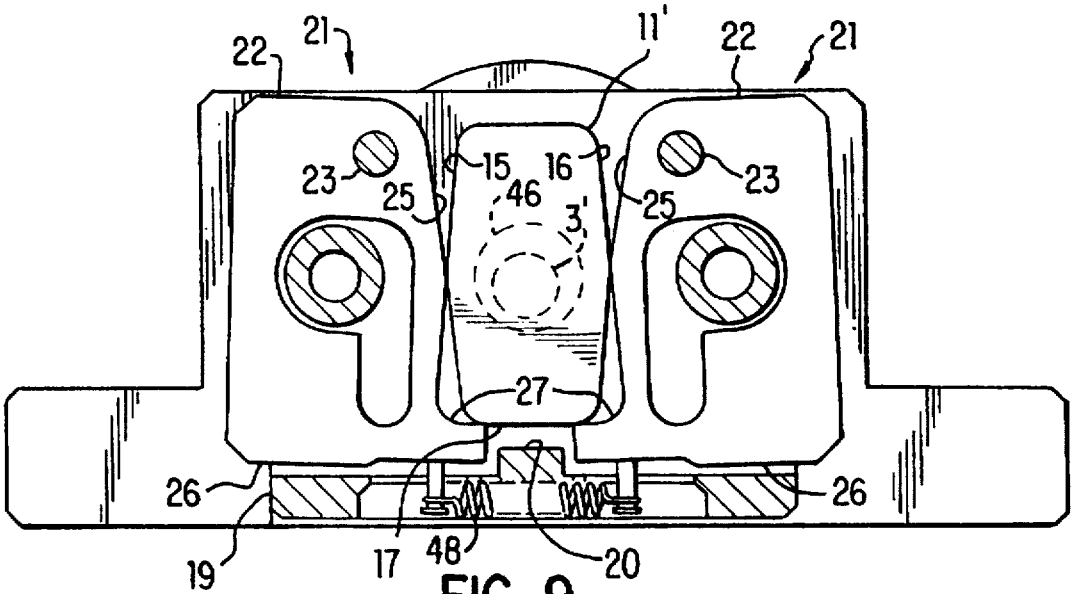
FIG. 9 is a view similar to FIG. 8 with a lock housing of a second size shown schematically in the holding device.

FIGS. 8 and 9 show the holding device in position to support padlocks of two different sizes. FIG. 8 shows a small padlock with the lock housing seated on the support arms 27. In this position, the lock housing 11 fits easily between the opposed surfaces 25 of the guides 21. The positioning of the arms 27 is such so that the plug 3' of the lock housing will be in axial alignment with plug extension piece 46. The position of the guides 21 in FIG. 8 is a closed position with the arms positioned in spaced relation above support 20 of the base 19 of the holding device. Preferably the guide 21 are weighted and the pivots 23 are located so that the guides hang by gravity in the closed position shown in FIG. 8. To assure that the guides remain in the closed position while the lock housing is placed between them, a spring 48 is attached to the lower ends 26 of the guides by way of the posts 49 extending downwardly from the ends 26.

The holding device is shown in FIG. 8 for receiving a lock housing of a particular size. It is to be understood that other lock housings of other sizes which do not differ significantly from the size of the lock housing shown in FIG. 8 can also be placed in the holding device and supported by the arms 27. For example, a lock housing 11' slightly larger size than that of FIG. 8 is shown in FIG. 9. This housing engages the opposed surfaces 25 of the guides and causes the guides to pivot slightly about their pivots 23. Nevertheless, the arms 27 remain in supporting relation under the lock housing. The difference in the location of the shell-plug assembly between the lock housings 11 and 11' is insignificant as far as alignment with the plunger extension piece 46 is concerned. The plunger piece need not be precisely aligned axially with the plug for the shearing operation.

Figure 10:
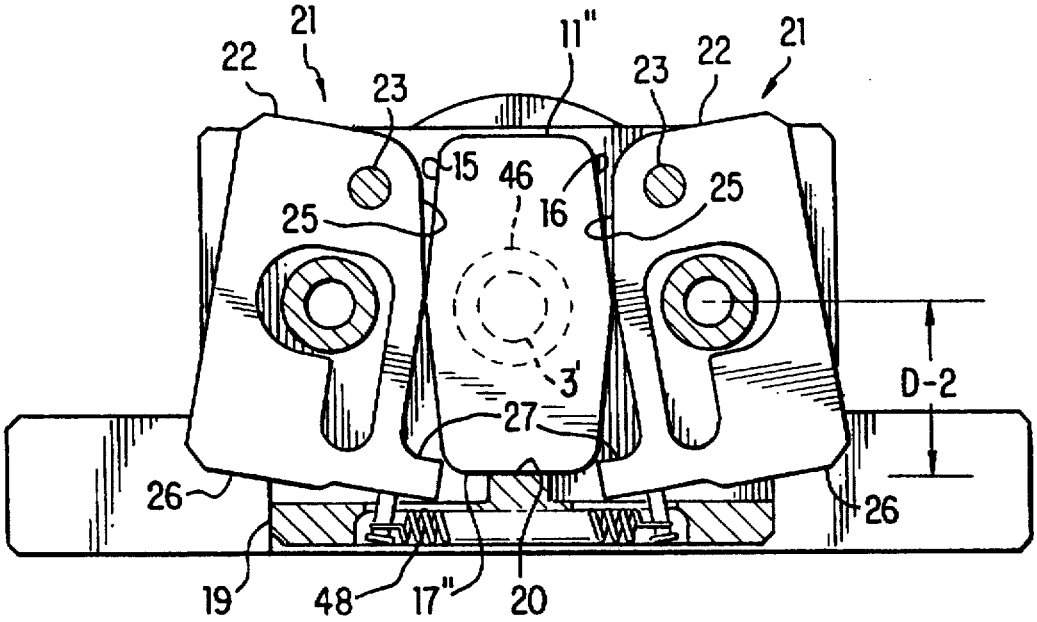
FIG. 10 is another view similar to FIG. 8 with a lock housing of a third size shown schematically in the holding device.

FIG. 10 shows the holding device in position for receiving a lock housing 11" which is measurably different in size from the lock housings 11 and 11". With the lock housing 11" the front and back walls 15, 16 engage against the surfaces 25 of the guides to cause pivoting of the guides about the pivots 23. This pivoting is effected because the surfaces 25 are spaced from each other by a distance which is less than the spacing between the pivots 23. In addition, the surfaces 25 are shaped to provide a minimum spacing midway between their upper and lower ends 22, 26. Thus, when the lock housing 11" is inserted between the guides, the upper portions of the surfaces 25 provide a caming surface against which the lock housing engages to cause the pivoting of the guides. The extent of pivoting of the guides is sufficient to provide access to the support 20 so that the side wall 17" of the lock housing can rest on this support. It will be noted that in this position of the lock housing 11" the minimum spacing of the guides 21 is located slightly above the maximum housing width of the lock housing 11'. In this position, the guides function to resiliently hold the shell housing 11" against the support 20.

With the lock housings 11, 11' and 11", the location of the plug of the lock housing is spaced at different heights from the lower side wall of the housing. In the lock housing shown in FIG. 8, this spacing is represented by the distance D-1; whereas with the lock housing 11" shown in FIG. 10, this spacing is represented by the distance D-2. The difference between these two distances provides a reference distance RD. This reference distance is used in determining the spacing by which the upper support surfaces of the arms 27 are spaced above the support 20. This reference distance is shown in FIG. 8.

Although the holding device is shown with two supports which are located in predetermined positions for reception of lock housings of particular sizes, it is to be understood that these supports can be adapted for reception of other lock housings. For example, shims can be used to raise the level of either of the supports so as to accommodate smaller lock housings.

We claim:

1. A holding device for objects of different sizes comprising:

a) a horizontal base defining a first support;

b) a pair of guide members with upper and lower ends and opposed horizontally spaced surfaces between which said objects are to be positioned for supporting on one of said first support and a second support;

c) a support arm on the lower end of each guide member, with the arm of one guide member extending toward the arm of the other guide member;

d) said guide members being pivotally mounted relative to and above said base and extending downwardly toward said base for pivoting movement relative to said base between a first closed position with said arms defining said second support spaced in vertical alignment above said first support and a second open position spaced laterally of said first support to provide access between said arms to said first support for supporting an object.

2. The holding device of claim 1, further comprising:

a) pivot means for pivotally mounting each of said guides at their upper ends, said pivot means being spaced from each other by a predetermined distance; and b) the opposed surfaces of said guide members extend downwardly from said pivot means toward each other to define a minimum spacing therebetween which is less than said predetermined distance.

3. The holding device of claim 1, wherein:

a) said guide members are pivotally mounted to hang by gravity in said first closed position.

4. The holding device of claim 1, further comprising:

a) spring means connected between the lower ends of said guide members to resiliently hold them in said first closed position.

5. A holding device for holding different sized lock housings, each lock housing having opposed front and back walls, spaced from each other to define a lock housing width, and opposite side walls connecting said front and back walls together, and a plug assembly with shearable pins positioned in said housing centrally between said side walls, the plug assembly of a first lock housing, with a first housing width, being spaced from said side walls thereof by a first distance and the plug assembly of a second lock housing, with a second housing width smaller than said first housing width, being spaced from the side walls thereof by a second distance less than said first distance to define a predetermined reference distance, the apparatus comprising:

a) a horizontal base defining a first support for said first lock housing;

b) a pair of guide members with upper and lower ends and opposed horizontally spaced surfaces between which said lock housings are to be positioned, said surfaces being spaced from each other by a minimum spacing less than said first lock housing width;

c) a support arm on the lower end of each guide member, with the arm of one guide member extending toward the arm of the other guide member;

d) said guide members being pivotally mounted relative to and above said base and extending downwardly toward said base for pivoting movement relative to said base between a first closed position with said arms defining a second support for said second lock housing spaced in vertical alignment above said first support by said predetermined reference distance and a second open position spaced laterally of said first support to provide access between said arms to said first support for said support lock housing; and e) pivot means for pivotally mounting each of said guide members at their upper ends, said pivot means being spaced from each other by a distance greater than said minimum spacing of the opposed surfaces of said guide members.

6. The device of claim 5 for holding lock housing, each of which has a varying lock housing width which is at a maximum centrally between said side walls, wherein:

a) the spacing between the opposed surfaces of said guide means varies and is at a minimum at a location along said opposed surfaces which is located above the maximum housing width of a lock housing supported on either one of said first and second supports.

* * * * *